US011123758B2

(12) United States Patent
Blum et al.

(10) Patent No.: US 11,123,758 B2
(45) Date of Patent: Sep. 21, 2021

(54) APPARATUS FOR COATING A LAPPING PLATE PLATEN, AND RELATED METHODS OF USING

(71) Applicant: Seagate Technology LLC, Cupertino, CA (US)

(72) Inventors: Nicholas Blum, St. Paul, MN (US); Andrew Habermas, Bloomington, MN (US); Ricky Anderson, Bloomington, MN (US); Mihaela Ruxandra Baurceanu, Edina, MN (US)

(73) Assignee: Seagate Technology LLC, Fremont, CA (US)

( * ) Notice: Subject to any disclaimer, the term of this patent is extended or adjusted under 35 U.S.C. 154(b) by 57 days.

(21) Appl. No.: 16/542,483

(22) Filed: Aug. 16, 2019

(65) Prior Publication Data

US 2020/0061644 A1 Feb. 27, 2020

Related U.S. Application Data

(60) Provisional application No. 62/720,220, filed on Aug. 21, 2018.

(51) Int. Cl.

| | |
|---|---|
| ***B05D 1/12*** | (2006.01) |
| ***B05B 7/14*** | (2006.01) |
| ***B05B 7/24*** | (2006.01) |
| ***B24B 37/14*** | (2012.01) |
| *B05B 15/60* | (2018.01) |

(52) U.S. Cl.
CPC ..... *B05B 7/1436* (2013.01); *B05B 7/149* (2013.01); *B05B 7/2478* (2013.01); *B24B 37/14* (2013.01); *B05B 15/60* (2018.02)

(58) Field of Classification Search
CPC ..... B05B 7/1436; B05B 7/149; B05B 7/2478; B05B 15/60; B24B 37/14
See application file for complete search history.

(56) References Cited

U.S. PATENT DOCUMENTS

| | | | | |
|---|---|---|---|---|
| 3,558,052 | A | 1/1971 | Dunn | |
| 5,368,618 | A * | 11/1994 | Masmar | B24D 3/342 51/295 |
| 5,803,367 | A | 9/1998 | Heard et al. | |
| 2017/0304988 | A1 | 10/2017 | Moudry et al. | |

OTHER PUBLICATIONS

Kremlin Rexson, Automatic Airspray Gun A35, Retrieved from, 'http://notices.kremlinrexson-sames.com/prod/notices/576.001.190/fold/notices/578.021.120-UK.pdf', on Aug. 16, 2019, (9 pages).
Powder Buy the Pound: Liquid 2 Powder (1 Pint), Retrieved from, 'https://www.powderbuythepound.com/liquid-2-powder-1-pint.html', on Aug. 16, 2019, (2 pages).

* cited by examiner

*Primary Examiner* — Alexander M Weddle
(74) *Attorney, Agent, or Firm* — Kagan Binder, PLLC

(57) ABSTRACT

The present disclosure involves apparatuses and methods for coating a lapping plate with an aqueous composition. The apparatus can be configured and the aqueous composition can be formulated so that the aqueous composition can flow to a spray nozzle device solely due to gravity in a batchwise manner.

20 Claims, 4 Drawing Sheets

APPARATUS FOR COATING A LAPPING PLATE PLATEN, AND RELATED METHODS OF USING

RELATED APPLICATION

The present nonprovisional patent application claims the benefit of commonly owned provisional Application having Ser. No. 62/720,220, filed on Aug. 21, 2018, which provisional pplication is incorporated herein by reference in its entirety.

BACKGROUND

The present disclosure relates to apparatuses and related methods for coating a lapping plate that can be used to lap (abrade) one or more bars of sliders. Sliders can be made out of ceramic material such as a two phase mixture of alumina and titanium-oxide (also referred to as AlTiC).

SUMMARY

Embodiments of the present disclosure include a method of coating a lapping plate platen, wherein the method comprises:

a) providing a first volume of an aqueous composition in a container, wherein the aqueous composition comprises:

i) a solid resin powder;

ii) a plurality of solid abrasive particles; and iii) an aqueous carrier;

b) providing a spray nozzle device in fluid communication with the container;

c) spraying a second volume of the aqueous composition onto an underlying lapping plate platen to form a layer of an aqueous composition on the surface of the platen, wherein the aqueous composition has a viscosity so that the aqueous composition can flow from the container to the spray nozzle device due to gravity.

Embodiments of the present disclosure also include an apparatus for coating a lapping plate platen, wherein the apparatus comprises:

a) a container having a capacity to contain a first volume of an aqueous composition, wherein the aqueous composition comprises:

i) a solid resin powder;

ii) a plurality of solid abrasive particles; and iii) an aqueous carrier;

b) a spray nozzle device coupled to the container so that a second volume of the aqueous composition having a viscosity can flow from the container to the spray nozzle device due to gravity;

c) a mounting device configured to mount the lapping plate platen, wherein the spray nozzle device is configured to spray the second volume of the aqueous composition onto the underlying lapping plate platen to form a layer of an aqueous composition on the surface of the platen.

DETAILED DESCRIPTION

A lapping plate according to the present disclosure can be used in a lapping tool/apparatus to abrade the surface of a slider (e.g., art air bearing surface). If desired, a slurry can be applied to the lapping surface of a lapping plate to enhance the abrasive action as the lapping surface is rotated relative to a slider bar containing a plurality of the sliders held in a pressing engagement against the lapping surface. A lapping plate according to the present disclosure can be used for a variety of lapping processes such as rough lapping, fine lapping, and kiss lapping.

A lapping plate platen according to the present disclosure can be made of one or more layers and/or of one or more materials in each layer. As discussed below, abrasive particles, solid resin powder, and an aqueous carrier can be applied to a surface of a platen. In some embodiments, a platen according to the present disclosure can be made out of one or more materials such as plastic, metals, and the like. In some embodiments, at least the surface that the abrasive particles, solid resin powder, and aqueous carrier are applied to is made out of one or more metals. Exemplary metals include at least one of tin, tin alloy, aluminum, copper, combinations of these, and the like.

Embodiments of the present disclosure include a spray system configured to apply a coating composition to a lapping plate platen to form a lapping plate. A non-limiting example of a spray system and method according to the present disclosure is described herein below with respect to FIGS. 1A-1D.

Figure 1A:
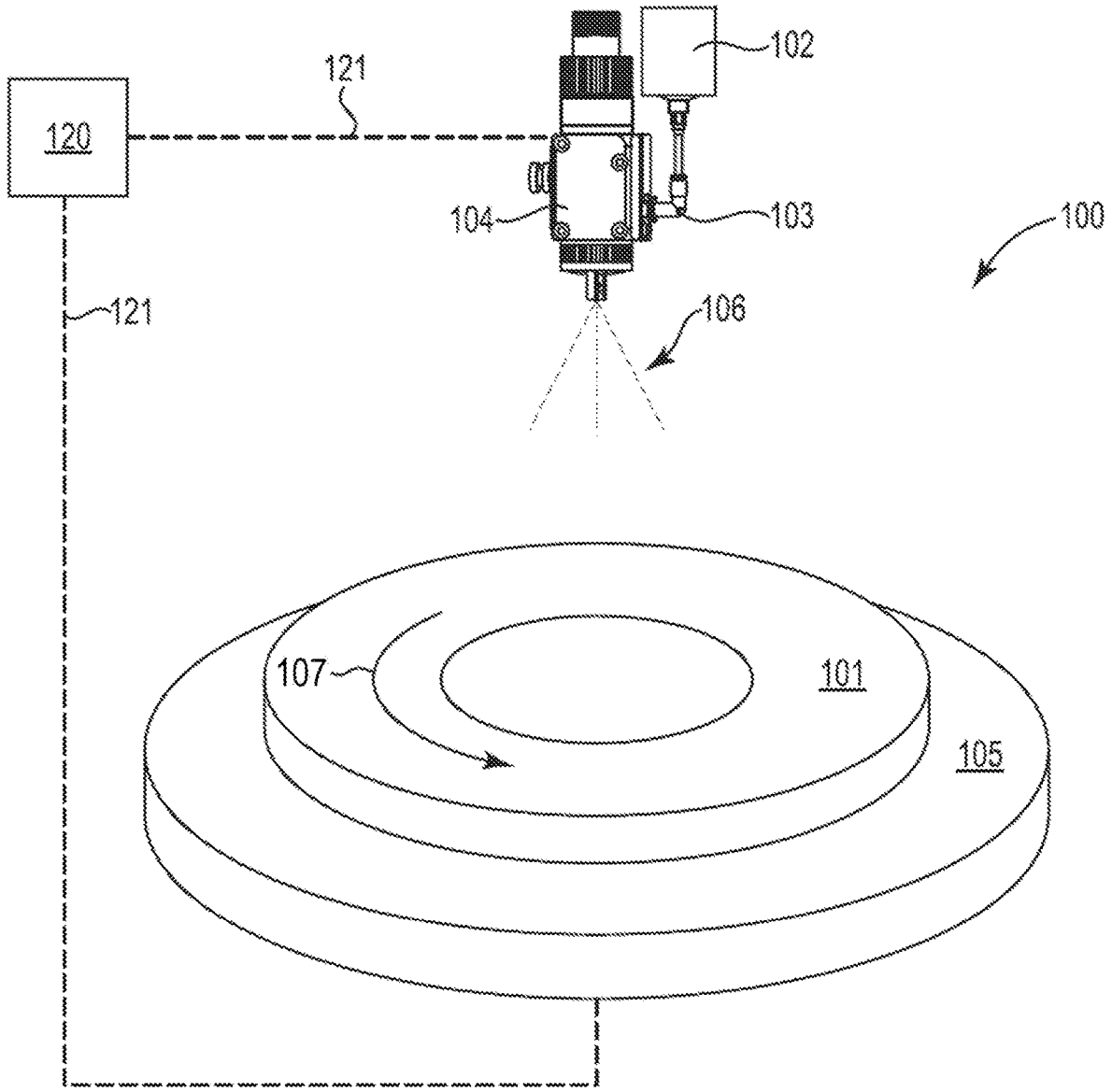
FIG. 1A is a schematic perspective view showing an apparatus for coating a lapping plate platen.

FIG. 1A shows a schematic, perspective view of an apparatus 100 for coating a lapping plate platen 101. As shown in FIG. 1, apparatus 100 includes a container 102 in fluid communication with a spray nozzle device 104. The container 102 is physically coupled to and is in fluid communication with spray nozzle device 104 via piping 103. As shown in FIG. 1A, lapping plate platen 101 is mounted to rotatable mounting device 105 that can rotate (as indicated by arrow 107 while a coating composition is sprayed 106 onto lapping plate platen 101.

A container 102 can have a variety of capacities. In some embodiments, as discussed further below, the capacity of a container can permit the apparatus to coat a lapping plate platen in a batch manner while having a relatively small amount of residual coating composition remaining in the container after coating. Further, the configuration (e.g., diameter and height) of a container 102 can be selected so that for a given batch volume of aqueous composition provides a "head" pressure that can force the aqueous composition to flow through piping 103 at a desirable flow rate into spray nozzle device 104. In some embodiments, a container 102 can include graduation markings (e.g., a graduated cylinder) that show the volume at various locations to assist in filling with coating composition. In some embodiments, the container can have a capacity from 10 to 500 milliliters, or even from 30 to 200 milliliters.

As shown in FIG. 1A, piping 103 can be relatively short and provide fluid communication between container 102 and spray nozzle device 104. In some embodiments, as shown in FIG. 1A, the container 102 is located above and relatively close to the opening into spray nozzle device 104 so that, as discussed below, the aqueous composition can flow through appropriately sized piping 103 at a desired flowrate directly into the spray nozzle device 104 due solely to gravity. The diameter and length of piping can influence the flow rate of the aqueous composition. Increasing the diameter and/or decreasing the length of piping 103 can increase flow rate. Decreasing the diameter and/or increasing the length of piping 103 can decrease flow rate. In some embodiments, the piping 103 can have a outside diameter in the range from 1 to 10 millimeters, or even from 2 to 5 millimeters. In some embodiments, the length of piping 103 can be in the range from 10 to 70 millimeters, or even from 30 to 60 millimeters. Piping 103 can advantageously avoid relatively long fluid delivery lines, which can waste coating material that is not sprayed onto a lapping plate platen and/or can avoid particle sedimentation that may occur when the coating composition is not flowing through the line, e.g., when lapping plate platens are being transferred out of and/or into the apparatus 100.

A spray nozzle device according to the present disclosure is configured to spray an aqueous composition onto the underlying lapping plate platen to form a layer of an aqueous composition on the surface of the platen. The aqueous composition can be cured and become an abrasive layer on the surface of the lapping plate platen.

Figure 1B:
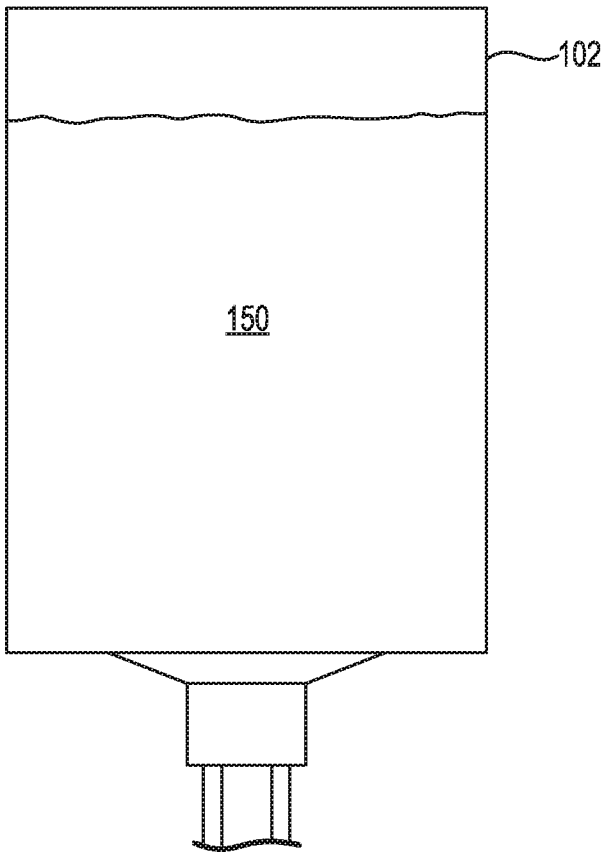
FIG. 1B is a schematic perspective view showing a close-up of the container in the apparatus of FIG. 1A when the container is initially filled with a coating composition.
Figure 1C:
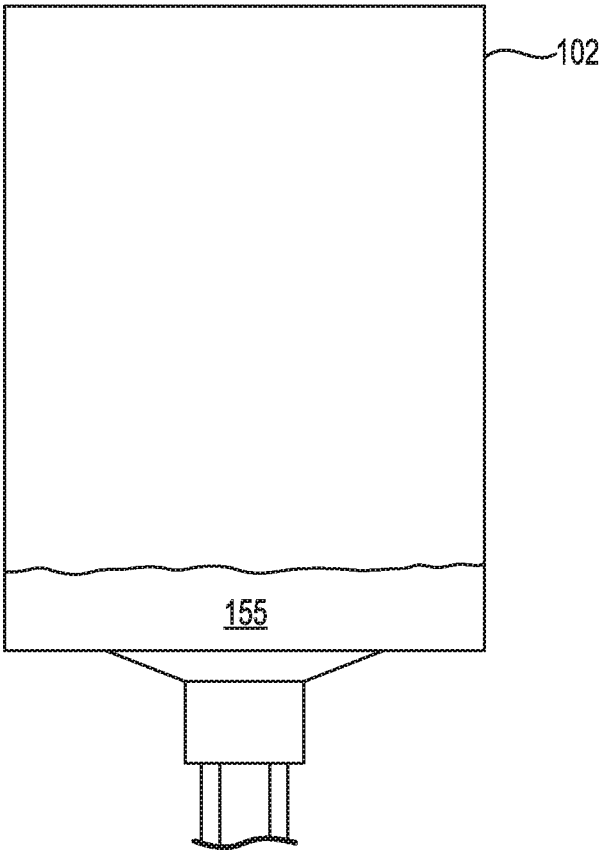
FIG. 1C is a schematic perspective view showing a close-up of the container in the apparatus of FIG. 1A after a lapping plate platen has been coated with the coating composition according to a batch process.
Figure 1D:
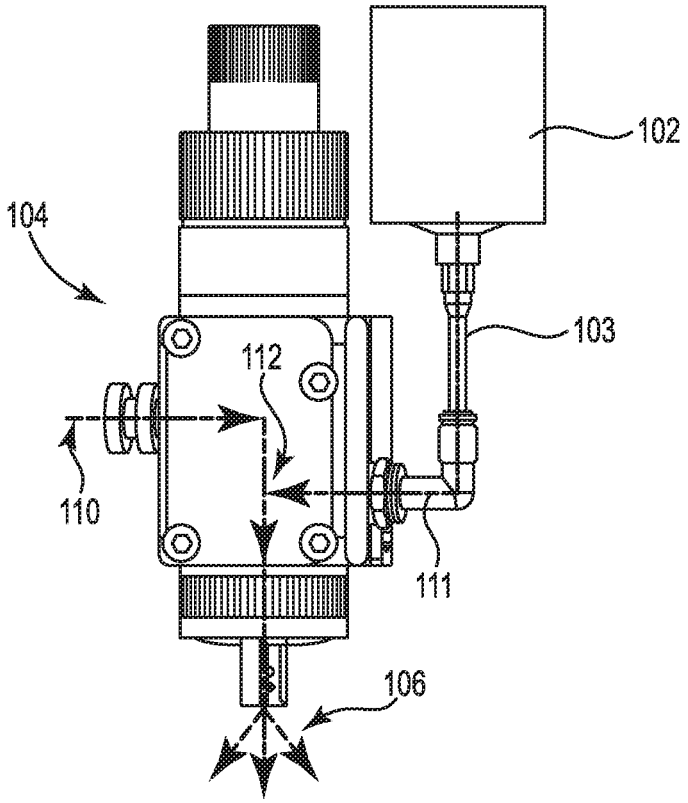
FIG. 1D is a schematic close up view of the spray nozzle device and container shown in FIG. 1A.

An example of a spray nozzle device is illustrated in FIGS. 1A and 1D. As shown in FIG. 1D, a coating composition is provided in container 102 and can flow via gravity through piping 103 and into spray nozzle device 104 as shown by path 111. A flow of pressured gas 110 can be supplied to spray nozzle 104 so that it can mix with the coating composition at point 112 and atomize the coating composition into spray 106.

An example of a spray nozzle device that is commercially available includes a high volume, low-pressure (HVLP) automatic airspray gun sold under the tradename A35 automatic airspray gun from Kremlin-Rexson (Stains Cedex-France).

The flow rate of an atomized aqueous composition from nozzle device 104 can be influenced by (in addition to other factors as described herein such as liquid viscosity) the size of the spray nozzle or nozzles, the atomization gas pressure, and/or any other componentry in the flow path of nozzle device 104.

In some embodiments, as shown in FIG. 1A, apparatus 100 can also include a controller 120 in electrical communication 121 with one or more components (e.g., spray nozzle device 104 and rotatable mounting device 105) of apparatus 100 to execute one or more functions as described herein with respect to exemplary methods. For example, controller 120 can open a valve of the spray nozzle device 104 to spray aqueous coating composition 106 onto an underlying lapping plate platen 101. Controller 120 can also close the valve to stop spraying. In some embodiments, apparatus 100 can simply include a solenoid valve to turn a gas supply for atomization in nozzle device 104 on or off.

Now, an example of coating a lapping plate platen is described with respect to FIGS. 1A-1C.

In some embodiments, a method according to the present disclosure includes providing a first volume 150 of an aqueous composition in container 102. The aqueous composition can include a solid resin powder, a plurality of solid abrasive particles, an aqueous carrier, and optionally, one or more additives. An example of an aqueous, coating composition is described in U.S. Pub. No. 2017/0304988 (Moudry et al.), wherein the entirety of said publication is incorporated herein by reference.

Solid resin powder according to the present disclosure can include a solid resin powder that can be applied to at least a portion of the surface of a platen and subsequently cured so that the solid, uncured resin powder melts and flows to form, along with abrasive particles, a continuous cured coating suitable for lapping a bar of sliders. Because the resin powder is solid, it can be applied to the surface of a platen in solid form.

A solid resin powder can be selected based on one or more of its characteristics such as the ability to be sprayed via apparatus 100, how the resin performs in forming a coating on a platen, how the resin performs in an abrasive coating during lapping, combinations of these, and the like. For example, a resin powder can be selected to help provide the abrasive coating with desirable chemical and mechanical resistance during lapping. As another example, a solid resin powder can be selected based on one or more of average particle diameter, particle density, and overall amount by weight to be used so that the solid resin powder interacts with the abrasive particles and aqueous carrier in a desired manner during application and in the final coating (further discussed below).

Solid resin powder can have an average particle diameter that permits the solid resin powder to be applied to a platen in a desirable manner. For example, the average particle diameter can be a size that permits the solid resin powder to be handled and dispensed (e.g., sprayed) by equipment discussed below. In some embodiments, solid resin powder can have an average particle diameter in the range from 0.1 to 100 micrometers, from 0.1 to 20 micrometers, or even from 0.1 to 5 micrometers.

Solid resin powder can have a particle density that permits the solid resin powder to be applied to a platen in a desirable manner. In some embodiments, solid resin powder can have a particle density in the range from 0.5 to 50 grams per cubic centimeter, from 0.5 to 20 grams per cubic centimeter, or even from 1 to 10 grams per cubic centimeter.

A solid resin powder can be made out of one or more materials from among a wide variety of chemistries. In some embodiments, a solid resin powder includes thermosetting solid resin powder. In some embodiments, a solid resin powder is selected from the group consisting of solid epoxy resin powder, solid vinyl resin powder, solid polyester resin powder, and blends thereof. In some embodiments, the solid resin powder is polyester resin. Exemplary solid resin powder is commercially available under the tradename 1 Coat Silver polyester resin powder from NIC Industries, White City, Oreg., or the tradename Epoxy Primer epoxy resin powder from NIC Industries, White City, Oreg.

A plurality of abrasive particles according to the present disclosure can include abrasive particles than can be applied to at least a portion of the surface of a platen and form, along with cured resin, an abrasive coating suitable for lapping a bar of sliders.

Abrasive particles can be selected based on one or more of their characteristics such as the ability to be sprayed via apparatus 100, how the abrasive particles influence the forming of the abrasive coating on a platen, how the abrasive particles perform in an abrasive coating during lapping, combinations of these, and the like. For example, abrasive particles can be selected to help provide the abrasive coating with desirable abrading characteristics during lapping. As another example, abrasive particles can be selected based on one or more of average particle diameter, particle density, and overall amount by weight to be used so that the abrasive particles interact with the solid resin powder and/or aqueous carrier in a desired manner. For example, one or more of average particle diameter, particle density, and overall amount of each of the solid resin powder and abrasive particles can be selected to help prevent either the abrasive or resin from settling out of a mixture of the two in an aqueous carrier (e.g., during mixing, storing (e.g., in a container), during application to a platen, or while on the surface of a platen).

Abrasive particles can have an average particle diameter that permits the abrasive particles to be applied to a platen in a desirable manner. The average particle diameter of the abrasive particles can be selected depending on whether lapping involves rough lapping, fine lapping, and/or kiss lapping. In some embodiments, the abrasive particles can have an average particle diameter in the range from 0.01 to 10 micrometers. In some embodiments, the abrasive particles can have an average particle diameter less than 0.1 micrometers (e.g., for "kiss" lapping). In some embodiments, the abrasive particles can have an average particle diameter in the range from 0.1 to 1 micrometers (e.g., for "fine" lapping). In still other embodiments, the abrasive particles can have an average particle diameter in the range from greater than 1 micrometer to 3 micrometers (e.g., for "rough" lapping).

Abrasive particles can have a particle density that permits the abrasive particles to be applied to a platen in a desirable manner. In some embodiments, the abrasive particles can have a particle density in the range from 0.5 to 50 grams per cubic centimeter, from 0.5 to 20 grams per cubic centimeter, or even from 1 to 10 grams per cubic centimeter.

Abrasive particles according to the present disclosure can be made out of one or more materials. In some embodiments, abrasive particles are selected from the group consisting of diamond particles, cubic boron nitride particles, alumina particles, alumina zirconia particles, silicon carbide particles, and combinations thereof. In some embodiments, abrasive particles can be embedded within a ceramic material such as embedded diamond particles (embedded abrasive particles can also be referred to as encapsulated or composite abrasive particles, or even abrasive beads). Embedded abrasive particles are larger in size as compared to bare abrasive particles because the abrasive particles are embedded within ceramic material. For example, in some embodiments, embedded abrasive particles can have an average particle diameter in the range from 10 to 50 micrometers.

An aqueous carrier can provide a medium for the solid resin powder and abrasive particles to be suspended so that the solid resin powder and abrasive particles can be sprayed on a surface of a platen so as to form a layer so that the solid resin powder can eventually be cured to help form an abrasive coating.

An aqueous carrier can include at least water. In some embodiments, an aqueous carrier can include water and a dispersant. A dispersant can help facilitate dispersing the solid resin powder and/or abrasive particles in water so as to form a suspension of the solid resin powder and/or abrasive particles in liquid water. In some embodiments, a dispersant includes at least one surfactant. Exemplary surfactants include anionic surfactants, nonionic surfactants, and mixtures thereof.

A dispersant can be present in the aqueous carrier in a variety of amounts. In some embodiments, the dispersant can be present in the aqueous carrier in an amount of 10 percent or less by weight based on the total weight of the aqueous carrier, or even 5 percent or less by weight based on the total weight of the aqueous carrier.

In some embodiments, an aqueous carrier can include one or more organic solvents. An exemplary organic solvent includes 1-Methyl-2pyrrolidone (NMP). In some embodiments, the organic solvents can be included in an amount of 10 percent or less by weight based on the total weight of the aqueous carrier. In some embodiments, the organic solvents can be included in an amount of 5 percent or less by weight based on the total weight of the aqueous carrier. In some embodiments, the organic solvents can be included in an amount of 1 percent or less by weight based on the total weight of the aqueous carrier.

An example of an aqueous carrier suitable for forming a suspension of solid resin powder and abrasive particles is commercially available under the tradename "Liquid 2 Powder" from Powder Buy The Pound, Nolensville, Tenn.

If the abrasive particles and solid resin powder are applied to a platen sequentially, the aqueous carrier used with each of the abrasive particles and solid resin powder can be the same or different as long as each aqueous carrier is compatible with the other.

Each of the solid resin powder, plurality of abrasive particles, and aqueous carrier can be included in an aqueous composition in an amount so as to facilitate coating, while at the same time providing desirable coating properties for lapping. In some embodiments, aqueous carrier and the total of the solid resin powder and the plurality of abrasive particles are present in the aqueous composition in an amount so that the weight ratio of the total of the solid resin powder and plurality of abrasive particles to the aqueous carrier is in the range from 1 to 10, from 1 to 5, from 1 to 3, or even 1 to 1.2.

In some embodiments, each of the solid resin powder and the plurality of abrasive particles are present in an amount so that the weight ratio of the solid resin powder to the plurality of abrasive particles in the abrasive coating is in the range from 0.1 to 10, from 0.25 to 5, or even from 0.5 to 1.5.

In some embodiments, the average particle diameter of each of the solid resin powder and the abrasive particles can be selected so that the ratio of the of the solid resin powder average particle diameter to the abrasive particles average particle diameter is in the range from 0.5:1 to 5:1, from 0.5:1 to 2:1, or even from 0.5:1 to 1.5:1.

In some embodiments, the particle density of each of the solid resin powder and the abrasive particles can be selected so that the ratio of the of the solid resin powder particle density to the abrasive particles particle density is in the range from 0.1 to 10, from 0.25 to 5, from 0.5 to 1.5, or even from 0.8 to 1.2.

One or more optional additives can be included in an aqueous composition according to the present disclosure. Exemplary optional additives include fillers, pigments, and the like. An aqueous composition can be formed by a variety of techniques. For example, solid resin powder and/or a plurality of abrasive particles can be combined with an aqueous carrier and mixed so that the solid resin powder and/or abrasive particles become suspended in the aqueous carrier to form an aqueous composition that can be applied to a surface of a platen. The solid resin powder and a plurality of abrasive particles can be applied to the surface of the platen sequentially or as a mixture in a single step. In some embodiments, an aqueous composition that includes an aqueous carrier and both the solid resin powder and the plurality of solid abrasive particles (and one or more optional additives) can be applied to the surface of the platen in a single step.

The aqueous composition can be applied to the platen immediately after forming the aqueous composition or stored for a period of time in a container. Being able to apply the solid resin powder and abrasive particles in a single step can advantageously avoid, if desired, manufacturing protocols that apply a resin and abrasive particles in two or more steps. For example, an abrasive coating made from a two part liquid epoxy system (resin plus hardener) can be formed by applying the first part epoxy, the second part hardener, and then the abrasive particles. Such a three step process can lead to increased process time, a non-uniform coating on a platen, and/or inconsistent coatings among multiple platens.

In some embodiments, the aqueous composition can be applied to a lapping plate according to a batch process. For example, referring to FIG. 1B again, the first volume 150 is an amount that can fully coat no more than one lapping plate platen of the same size as the lapping plate platen yet permit some residual amount of aqueous composition to remain in container 102 after coating a lapping plate.

In some embodiments, before providing the first volume 150 of the aqueous composition in container 102, the aqueous composition can be formed by combining and mixing the components for a desired period of time (e.g., mixing at 1000-4000 rpms with a mixer for 3-10 minutes). If desired, the aqueous composition can be stored for a period time. As the desired time, the aqueous composition can be agitated to suspend the solid resin powder and plurality of solid abrasive particles throughout the aqueous carrier (e.g., manually shaken for 15-60 seconds). By handling the aqueous composition in this way, continuous mixing is not necessary, which can advantageously avoid undue damage to abrasive particles. After agitating, the first volume 150 of the aqueous composition can be provided in container 102. The first volume 150 can be in the range from 10 to 500 milliliters, or even from 30 to 200 milliliters.

A lapping plate platen 101 to be coated can mounted on mounting device 105 and rotated while a second volume of the aqueous composition is sprayed onto the underlying lapping plate platen 101 to form a layer of an aqueous composition on the surface of the platen 101. The aqueous composition can be permitted to flow by, e.g., supply atomization gas to nozzle device 104. After a desired amount of aqueous composition has been sprayed, the spraying can be stopped. As shown in FIG. 1C, a third volume 155 of the aqueous composition remains in the container 102, where the third volume 155 is less than the second volume applied to the lapping plate platen. By leaving a residual amount (third volume 155) of aqueous composition in container 102, introducing gas (e.g., air) through piping 103 can be avoided. Introducing gas through piping 103 can lead to undue "sputtering" of aqueous composition from nozzle device 104, which can lead to non-uniform coating of the aqueous composition on lapping plate platen 101.

In some embodiments, the aqueous composition has a viscosity so that the aqueous composition can flow from the container 102 to the spray nozzle device 104 due to solely to gravity. Accordingly, the aqueous composition can be formulated to accommodate this. For example, the aqueous composition can be formulated so that the aqueous composition has a Brookfield viscosity of 150 centipoise or less when measured at 21° C. and 60 rpm with a #3 spindle. In some embodiments, the aqueous composition has a Brookfield viscosity of 125 centipoise or less, 110 or less, or even 100 or less when measured at 21° C. and 60 rpm with a #3 spindle.

As shown in FIG. 1A, the container 102 is open to atmospheric pressure and is not a pressurized container so that the aqueous composition can flow solely due to gravity.

Advantageously, by formulating the aqueous composition so that it can be applied in a batch manner and flow to spay nozzle device 104 due solely to gravity, the coating apparatus and methodology according to the present disclosure can provide desirable volume control and/or avoid relatively long supply lines to the spray nozzle device, which can avoid undue settling of abrasive and/or resin particles in the lines.

After applying a coating of the aqueous composition onto the lapping plate platen 101, the aqueous carrier can be evaporated and the solid resin powder can be cured to form an abrasive coating comprising the solid abrasive particles and the cured resin.

What is claimed is:

1. A method of coating a lapping plate platen, wherein the method comprises:

a) providing a first volume of an aqueous composition in a container, wherein the aqueous composition comprises:
   i) a solid resin powder;
   ii) a plurality of solid abrasive particles; and
   iii) an aqueous carrier;
b) providing a spray nozzle device in fluid communication with the container;
c) spraying a second volume of the aqueous composition onto an underlying lapping plate platen to form a layer of the aqueous composition on the surface of the platen, wherein the aqueous composition has a viscosity so that the aqueous composition can flow from the container to the spray nozzle device due to gravity.

2. The method of claim 1, further comprising stopping the spraying the aqueous composition, wherein a third volume of the aqueous composition remains in the container, and wherein the third volume is less than the second volume.

3. The method of claim 1, wherein the first volume is an amount that can fully coat no more than the lapping plate platen.

4. The method of claim 1, wherein the aqueous composition has a Brookfield viscosity of 150 centipoise or less when measured at 21° C. and 60 rpm with a #3 spindle.

5. The method of claim 1, wherein providing the first volume comprises:

a) agitating the first volume to suspend the solid resin powder and plurality of solid abrasive particles throughout the aqueous carrier, wherein agitating is performed for a time period of 10 minutes or less; and
b) transferring the first volume to the container after agitating the first volume.

6. The method of claim 1, further comprising, after step (c):

a) evaporating the aqueous carrier; and
b) substantially curing the solid resin powder to form an abrasive coating comprising the solid abrasive particles and the cured resin.

7. The method of claim 1, wherein the aqueous carrier comprises water and a dispersant.

8. The method of claim 7, wherein the dispersant comprises a surfactant, and wherein the dispersant is present in an amount of 10 percent or less by weight based on the total weight of the aqueous carrier.

9. The method of claim 7, wherein the dispersant comprises at least one surfactant chosen from an anionic surfactant, an nonionic surfactant, and mixtures thereof.

10. The method of claim 7, wherein the aqueous carrier further comprises one or more organic solvents, wherein the one or more organic solvents are present in an amount of 10 percent or less by weight based on the total weight of the aqueous carrier.

11. The method of claim 1, wherein the solid resin powder has an average particle diameter in the range from 0.1 to 100 micrometers.

12. The method of claim 1, wherein the solid resin powder has a particle density in the range from 0.5 to 50 grams per cubic centimeter.

13. The method of claim 1, wherein the solid resin powder comprises thermosetting solid resin powder.

14. The method of claim 1, wherein the solid resin powder is chosen from solid epoxy resin powder, solid vinyl resin powder, solid polyester resin powder, and blends thereof.

15. The method of claim 1, wherein the abrasive particles have an average particle diameter in the range from 0.01 to 10 micrometers.

16. The method of claim 1, wherein the abrasive particles have a particle density in the range from 0.5 to 50 grams per cubic centimeter.

17. The method of claim 1, wherein the abrasive particles are chosen from diamond particles, cubic boron nitride particles, alumina particles, alumina zirconia particles, silicon carbide particles, and combinations thereof.

18. The method of claim 1, wherein the abrasive particles are embedded within ceramic material.

19. The method of claim 1, wherein the first volume is in the range from 10 to 500 milliliters.

20. The method of claim 1, wherein the aqueous carrier and a total of the solid resin powder and the plurality of solid abrasive particles are present in the aqueous composition in an amount so that a weight ratio of the total of the solid resin powder and the plurality of solid abrasive particles to the aqueous carrier is in the range from 1 to 10.

* * * * *